US006269518B1

(12) United States Patent
Yung

(10) Patent No.: US 6,269,518 B1
(45) Date of Patent: Aug. 7, 2001

(54) BAGLESS VACUUM CLEANER

(75) Inventor: Billy Yung, Hong Kong (HK)

(73) Assignee: Shell Electric Mfg. (Holdings) Co. Ltd., Chai Wan (HK)

( * ) Notice: Subject to any disclaimer, the term of this patent is extended or adjusted under 35 U.S.C. 154(b) by 0 days.

(21) Appl. No.: 09/457,613

(22) Filed: Dec. 8, 1999

(51) Int. Cl.[7] ..... A47L 9/16

(52) U.S. Cl. ..... 15/352; 15/353; 55/337; 55/DIG. 3

(58) Field of Search ..... 15/352, 353; 55/337, 55/DIG. 3

(56) References Cited

U.S. PATENT DOCUMENTS

| | | | |
|---|---|---|---|
| D. 305,269 | 12/1989 | Dyson | D32/22 |
| D. 343,707 | 1/1994 | Dyson | D32/22 |
| D. 365,669 | 12/1995 | Piccaluga et al. | D32/22 |
| D. 375,820 | 11/1996 | Piccaluga et al. | D32/22 |
| D. 379,694 | 6/1997 | Bradd | D32/31 |
| D. 385,072 | 10/1997 | Bradd | D32/31 |
| D. 407,874 | 4/1999 | Burchard et al. | D32/31 |
| 1,476,004 | 12/1923 | Orr | 15/383 |
| 1,508,315 | 9/1924 | Brockway | 15/352 |
| 1,631,549 | 6/1927 | Pease | 15/352 |
| 1,656,031 | 1/1928 | Aalborg | 15/346 |
| 1,742,671 | 1/1930 | Squires | 15/337 |
| 1,829,582 | 10/1931 | Carson | 15/347 |
| 1,965,614 | 7/1934 | Sellers | 15/375 |
| 2,017,893 | 10/1935 | Boettler | 15/383 |
| 2,064,587 | 12/1936 | Carlstedt | 15/330 |
| 2,254,666 | 9/1941 | Smellie | 15/319 |
| 2,272,814 | 2/1942 | Olson | 15/347 |
| 2,316,836 | 4/1943 | Breuer | 55/337 |
| 2,330,621 | 9/1943 | Radke | 15/347 |
| 2,337,936 | 12/1943 | Sellers | 15/347 |
| 2,375,331 | 5/1945 | Taylor | 15/330 |
| 2,394,923 | 2/1946 | Little | 55/337 |
| 2,409,230 | 10/1946 | Taylor | 15/352 |
| 2,416,417 | 2/1947 | Taylor | 15/330 |
| 2,416,418 | 2/1947 | Taylor | 15/330 |

(List continued on next page.)

FOREIGN PATENT DOCUMENTS

| | | |
|---|---|---|
| 1182613 | 2/1985 | (CA) . |
| 2061469 | 2/1992 | (CA) . |
| 2221500 | 11/1995 | (CA) . |
| 2210177 | 1/1996 | (CA) . |
| 2266115 | 3/1999 | (CA) . |
| 2221499 | 11/1999 | (CA) . |
| 0042723B1 | 8/1985 | (EP) . |
| 0127667B1 | 3/1987 | (EP) . |
| 09 28 594 A1 | 7/1999 | (EP) . |
| WO 99/34722 | 7/1999 | (WO) . |

*Primary Examiner*—Chris K. Moore
(74) *Attorney, Agent, or Firm*—Sheldon & Mak; Denton L. Anderson

(57) ABSTRACT

A bagless vacuum cleaner having a chasse, an air blower and a dust extraction and collection unit is provided. The dust extraction and collection unit has an easily removable inlet chamber and an easily removable outlet chamber. The inlet chamber is substantially cylindrical, and the outlet chamber is disposed concentrically within the upper portion of the inlet chamber. Duct work within the chasse conducts air from the base of the chasse and into the inlet chamber in tangential fashion, such that air swirls about the inside walls of the inlet chamber. Air within the inlet chamber is then allowed to escape from the inlet chamber into the outlet chamber via a plurality of small holes disposed in the side walls of the outlet chamber. Air within the outlet chamber is exhausted to the blower via a top wall opening in the outlet chamber. The outlet chamber contains a vertical, cylindrical filter disposed concentrically within the outlet chamber and a second, planar filter disposed across the top wall opening of the outlet chamber.

9 Claims, 4 Drawing Sheets

U.S. PATENT DOCUMENTS

| | | | | |
|---|---|---|---|---|
| 2,416,419 | | 2/1947 | Pickford | 15/330 |
| 2,475,808 | | 7/1949 | Storm, Jr. | 15/346 |
| 2,482,166 | | 9/1949 | Gage | 15/324 |
| 2,484,491 | | 10/1949 | Daugherty | 15/324 |
| 2,507,897 | | 5/1950 | Gavagnin | 96/318 |
| 2,516,707 | | 7/1950 | Lewyt et al. | 55/379 |
| 2,524,117 | | 10/1950 | Storm, Jr. | 15/331 |
| 2,564,339 | | 8/1951 | Nerheim | 15/344 |
| 2,592,710 | | 4/1952 | Kirby | 15/319 |
| 2,618,007 | | 11/1952 | Fuller | 15/347 |
| 2,648,396 | | 8/1953 | Kirby | 15/352 |
| 2,916,104 | | 12/1959 | Hultberg et al. | 15/429 |
| 2,921,646 | | 1/1960 | Poole | 55/327 |
| 3,040,366 | | 6/1962 | Vance | 15/354 |
| 3,078,650 | * | 2/1963 | Anderson et al. | 55/337 |
| 3,148,400 | | 9/1964 | Wörwag | 15/327.1 |
| 3,177,635 | | 4/1965 | Cawl et al. | 15/327.2 |
| 3,320,727 | | 5/1967 | Farley et al. | 15/353 |
| 3,482,276 | | 12/1969 | Fillery | 15/349 |
| 3,618,158 | | 11/1971 | Wörwag | 15/332 |
| 3,621,640 | | 11/1971 | Ohno et al. | 15/327.7 |
| 3,758,914 | | 9/1973 | Nupp et al. | 15/329 |
| 3,797,064 | | 3/1974 | MacFarland | 15/351 |
| 3,820,310 | | 6/1974 | Fromknecht et al. | 55/447 |
| 3,906,585 | | 9/1975 | Mattsson | 15/349 |
| 3,910,781 | | 10/1975 | Bryant, Jr. | 15/347 |
| 3,914,820 | | 10/1975 | Hankel | 15/344 |
| 4,072,483 | | 2/1978 | Doyle, Jr. | 15/347 |
| 4,108,778 | | 8/1978 | Lambert et al. | 210/297 |
| 4,118,208 | | 10/1978 | Klinedinst | 55/433 |
| 4,172,710 | | 10/1979 | Van Der Molen | 15/353 |
| 4,198,726 | | 4/1980 | Powell, Jr. | 15/312.2 |
| 4,268,288 | | 5/1981 | Coombs | 15/353 |
| 4,276,070 | | 6/1981 | Hug | 15/352 |
| 4,284,422 | | 8/1981 | Ferland | 55/300 |
| 4,355,434 | | 10/1982 | Gongwer | 15/327.1 |
| 4,373,228 | | 2/1983 | Dyson | 15/350 |
| 4,426,211 | | 1/1984 | Ataka et al. | 15/327.7 |
| 4,443,235 | | 4/1984 | Brenholt et al. | 15/326 |
| 4,443,910 | | 4/1984 | Fitzwater | 15/337 |
| 4,457,043 | | 7/1984 | Oeberg et al. | 15/346 |
| 4,486,206 | | 12/1984 | Miyakawa et al. | 55/337 |
| 4,523,936 | | 6/1985 | Disanza, Jr. | 15/347 |
| 4,547,206 | * | 10/1985 | Sovis et al. | 15/353 |
| 4,571,772 | | 2/1986 | Dyson | 15/335 |
| 4,573,236 | | 3/1986 | Dyson | 15/333 |
| 4,593,429 | | 6/1986 | Dyson | 15/353 |
| 4,617,034 | | 10/1986 | Ikezaki et al. | 15/326 |
| 4,643,748 | | 2/1987 | Dyson | 55/338 |
| 4,718,924 | | 1/1988 | DeMarco | 55/302 |
| 4,745,654 | | 5/1988 | Yamamoto et al. | 15/344 |
| 4,769,052 | | 9/1988 | Kowalski | 55/379 |
| 4,826,515 | | 5/1989 | Dyson | 55/345 |
| 4,853,008 | | 8/1989 | Dyson | 15/353 |
| 4,853,011 | | 8/1989 | Dyson | 55/345 |
| 4,944,780 | | 7/1990 | Usmani | 15/353 |
| 5,018,240 | | 5/1991 | Holman | 15/349 |
| 5,020,186 | | 6/1991 | Lessig, III et al. | 15/339 |
| 5,062,870 | | 11/1991 | Dyson | 96/400 |
| 5,078,761 | | 1/1992 | Dyson | 96/400 |
| 5,090,975 | | 2/1992 | Requejo et al. | 134/21 |
| 5,090,976 | | 2/1992 | Dyson | 55/337 |
| 5,101,532 | | 4/1992 | Dyson et al. | 15/320 |
| 5,115,538 | | 5/1992 | Cochran et al. | 15/383 |
| 5,135,552 | | 8/1992 | Weistra | 55/337 |
| 5,145,499 | | 9/1992 | Dyson | 15/352 |
| 5,160,356 | | 11/1992 | Dyson | 55/345 |
| 5,230,722 | | 7/1993 | Yonkers | 55/337 |
| 5,248,323 | | 9/1993 | Stevenson | 95/90 |
| 5,248,858 | | 9/1993 | Lin | 55/429 |
| 5,267,371 | | 12/1993 | Soler et al. | 15/327.5 |
| 5,271,751 | | 12/1993 | Lägler | 55/295 |
| 5,287,591 | | 2/1994 | Rench et al. | 15/328 |
| 5,307,538 | | 5/1994 | Rench et al. | 15/352 |
| 5,358,290 | | 10/1994 | Fleet et al. | 285/7 |
| 5,427,597 | | 6/1995 | Osendorf | 55/487 |
| 5,464,460 | | 11/1995 | Bosses | 15/347 |
| 5,558,697 | | 9/1996 | Dyson et al. | 95/12 |
| 5,593,479 | | 1/1997 | Frey et al. | 15/347 |
| 5,603,740 | | 2/1997 | Roy | 15/352 |
| 5,603,741 | | 2/1997 | Frey | 15/347 |
| 5,664,285 | | 9/1997 | Melito et al. | 15/352 |
| 5,685,894 | | 11/1997 | Bowerman et al. | 15/350 |
| 5,704,956 | | 1/1998 | Loveless et al. | 15/352 |
| 5,779,744 | | 7/1998 | Mueller et al. | 15/350 |
| 5,779,745 | | 7/1998 | Kilström | 15/350 |
| 5,829,090 | | 11/1998 | Melito et al. | 15/352 |
| 5,845,782 | | 12/1998 | Depew | 209/23 |
| 5,846,273 | | 12/1998 | Dyson | 55/337 |
| 5,853,440 | | 12/1998 | Dyson | 15/353 |
| 5,858,038 | | 1/1999 | Dyson et al. | 55/337 |
| 5,893,936 | | 4/1999 | Dyson | 15/353 |
| 5,893,938 | | 4/1999 | Dyson et al. | 55/426 |
| 6,003,196 | | 12/1999 | Wright et al. | 15/353 |
| 6,026,540 | | 2/2000 | Wright et al. | 15/347 |

* cited by examiner

BAGLESS VACUUM CLEANER

FIELD OF THE INVENTION

This invention relates generally to vacuum cleaners and, more particularly, to bagless vacuum cleaners.

BACKGROUND OF THE INVENTION

Bagless vacuum cleaners have become very popular over the last several years. This popularity is due in large part to the ease with which dust and dirt can be removed from such vacuum cleaners. In old style cloth bag-containing vacuum cleaners, dust and dirt removal is a difficult and awkward process, frequently requiring the user to extend his or her hand into the cloth bag to physically disengage dust clumps. Vacuum cleaners using disposable liner bags minimize the problems associated with cloth bags, but the use of such vacuum cleaners requires the continuous replenishment and installation of disposable liner bags. (Also, owners of older model disposable liner bag-containing vacuum cleaners often find it difficult to locate a source of properly sized replacement liner bags.)

Contrary to these problems associated with bag-containing vacuum cleaners, dirt and dust vacuumed up using bagless vacuum cleaners is conveniently deposited into an easily removable permanent container, from which dust and dirt can be disposed of without the effort associated with cloth bag-containing vacuum cleaners and without having to continually purchase and reinstall disposable liner bags.

Bagless vacuum cleaners of the prior art, however, have not been fully satisfactory. Most bagless vacuum cleaners have not demonstrated the ability to fully disengage dust and dirt from the vacuum air stream. Those prior art bagless vacuum cleaners which have been reasonably successful in disengaging dust and dirt from the vacuum air stream have required a high degree of mechanical complexity. Such mechanical complexity has tended to make those prior art bagless vacuum cleaners unduly expensive to manufacture and maintain.

Accordingly, there is a need for a bagless vacuum cleaner which avoids these problems with the prior art.

SUMMARY

The invention satisfies this need. The invention is (a) a chassis having a base unit and a housing unit, the base unit having an air inlet and roller means for moving the vacuum cleaner across a flat surface, (b) an air blower disposed within the chassis, (c) a dust reaction and collection unit disposed within the housing unit and (d) duct work for serially connecting in fluid communication the air inlet in the base unit, the inlet chamber, the outlet chamber and the air blower. The dust extraction and collection unit comprises an enclosed inlet chamber and an enclosed outlet chamber. The inlet chamber is substantially cylindrical with a typical internal diameter between about 130 mm and about 200 mm. The inlet chamber comprises a bottom wall, generally vertical sidewalls, an upper section, a lower section and an air inlet opening. The sidewalls have an interior height, typically between about 200 mm and about 250 mm, and the upper section of the inlet chamber has an air inlet opening through the sidewalls. The enclosed outlet chamber is disposed concentrically within the upper section of the inlet chamber. The outlet chamber has a bottom wall, a top wall and generally vertical sidewalls. The top wall has a top wall opening and the sidewalls have an interior height, typically between about 50 mm and about 100 mm. The sidewalls also have a large plurality of inlet apertures, each inlet aperture, typically defining an area between about 3 $mm^2$ and about 30 $mm^2$. The inlet apertures are disposed in a band around the sidewalls of the outlet chamber, the band typically has a width between about 20 mm and about 50 mm and a median line disposed between about 30 mm and about 50 mm above the bottom wall. The outlet chamber also has an upper section, a lower section and a circular exterior perimeter edge member disposed around the sidewalls in the lower section of the outlet chamber. The exterior edge member has a diameter which is typically between about 10 mm and about 60 mm less than the internal diameter of the inlet chamber.

In preferred embodiments, the outlet chamber contains at least one filter for filtering out residual dust within the air prior to the air being exhausted from the outlet chamber. In more preferred embodiments, the outlet chamber contains at least two separate filters. In still more preferred embodiments, an additional filter, most preferably a HEPA filter, is disposed downstream of the blower to remove virtually all remaining traces of entrained dust particles.

The invention has been found to provide a vacuum cleaner with all the conveniences of prior art vacuum cleaners, but with increased dust removal efficiency and without excessive mechanical complexity and resulting expense of manufacture.

DRAWINGS

These features, aspects and advantages of the present invention will become better understood with regard to the following description, appended claims and accompanying figures where:

DETAILED DESCRIPTION

The following discussion describes in detail one embodiment of the invention and several variations of that embodiment. This discussion should not be construed, however, as limiting the invention to those particular embodiments. Practitioners skilled in the art will recognize numerous other embodiments as well.

Figure 2:
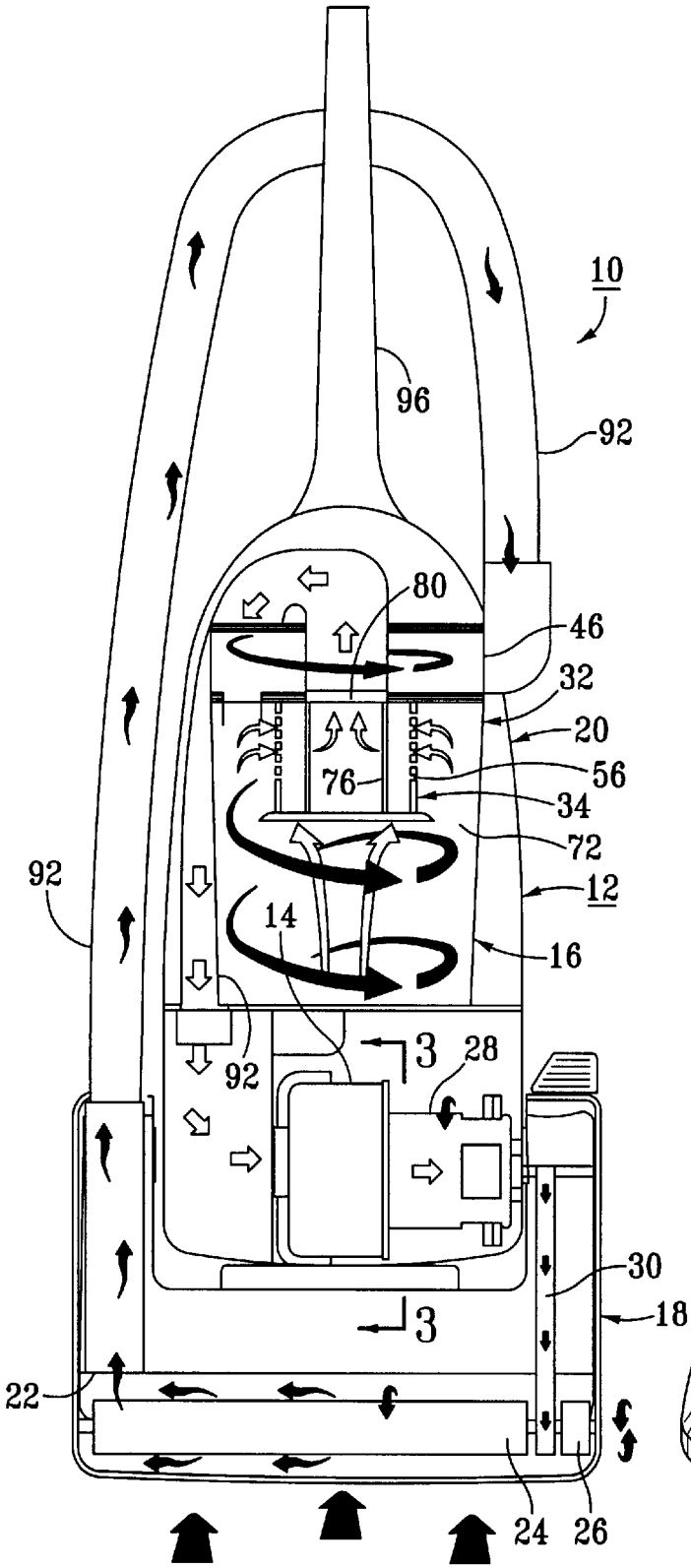
FIG. 2 is a diagrammatic cut away front view of the vacuum cleaner illustrated in FIG. 1.
Figure 1:
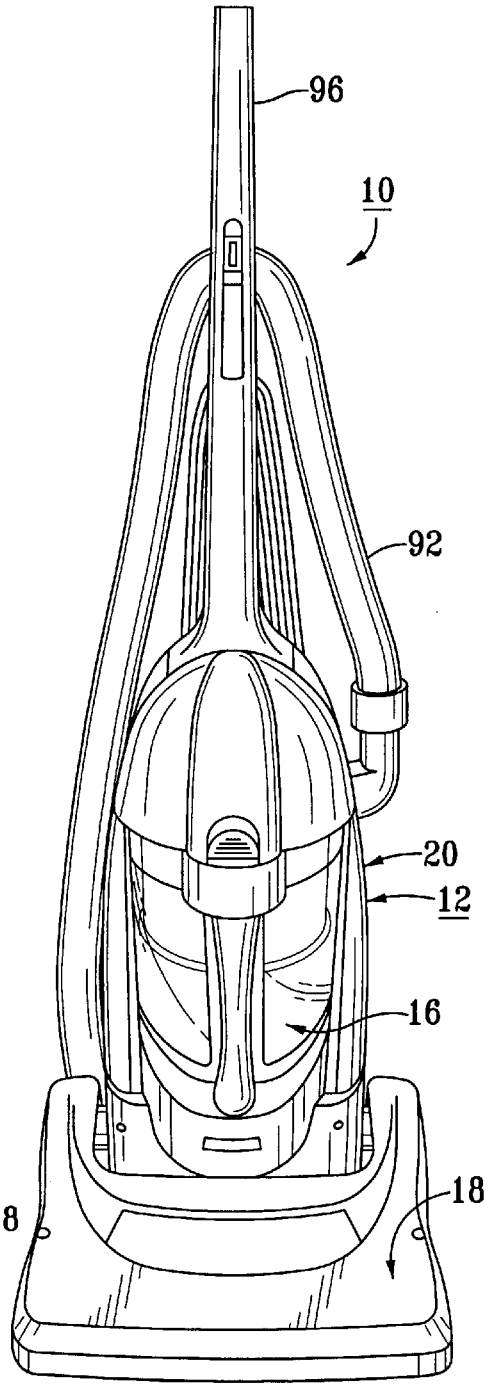
FIG. 1 is a perspective front view of a vacuum cleaner having features of the invention.
Figure 3:
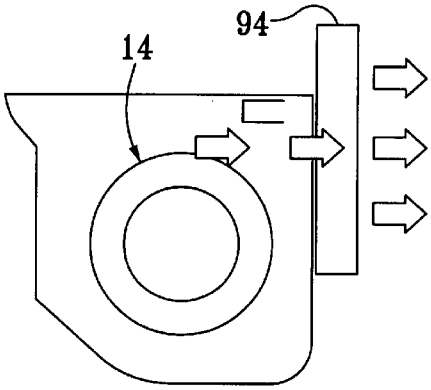
FIG. 3 is a detailed view of a blower and blower filter combination useable in the invention.
Figure 5:
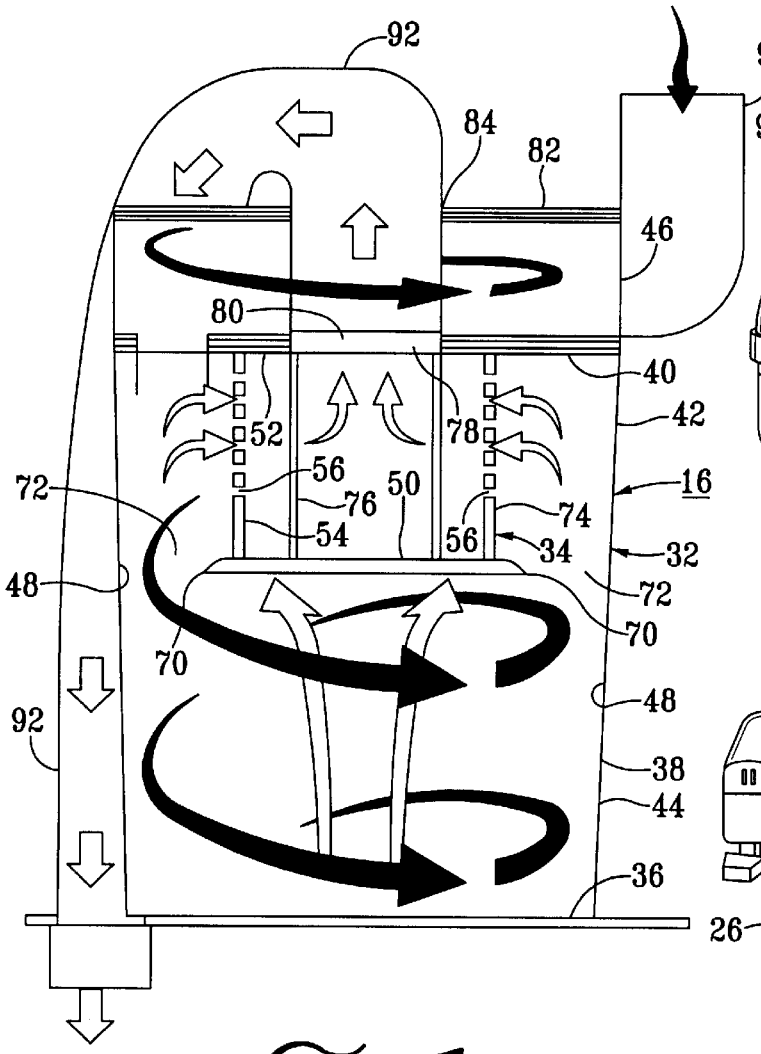
FIG. 5 is a diagrammatic detail view of a dust extraction and collection unit useable in the invention.
Figure 4:
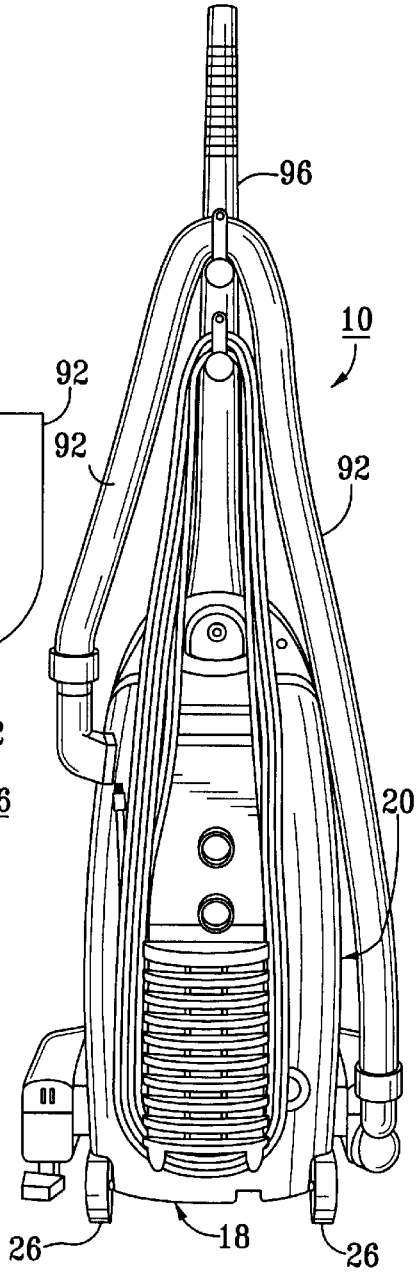
FIG. 4 is a perspective rear view of the vacuum cleaner illustrated in FIG. 1.
Figure 6:
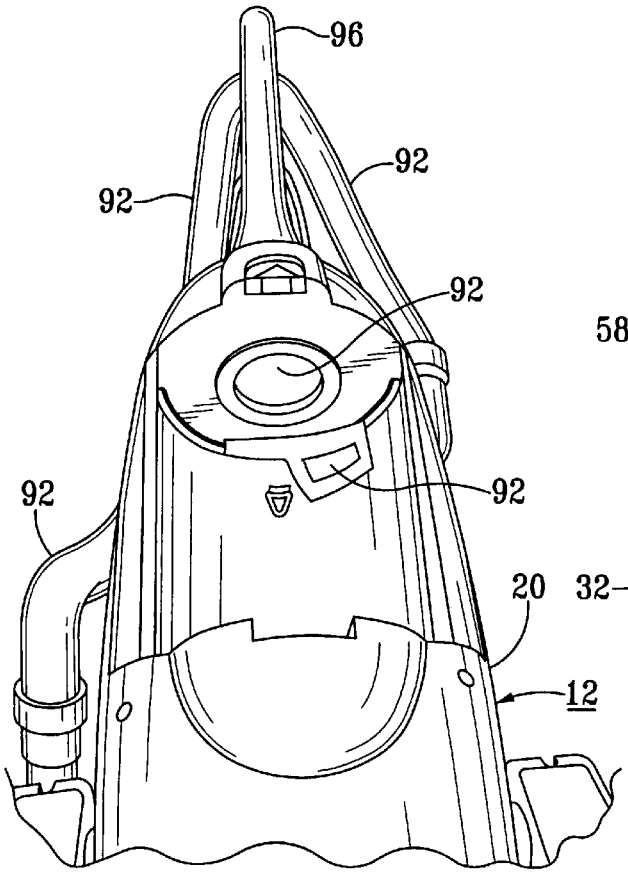
FIG. 6 is a perspective detail front view of a vacuum cleaner, such as illustrated in FIG. 1, wherein the dust extraction and collection unit has been removed.

As illustrated in FIGS. 1, 2 and 4, the invention is a vacuum cleaner 10 having a chassis 12, an air blower 14 and a dust extraction and collection unit 16.

The chassis 12 comprises a base unit 18 and a housing unit 20. The base unit 18 has an air inlet 22 wherein dust and dirt is sucked up into the chassis 12. In a typical embodiment, the base unit 18 includes a rotating horizontal floor brush 24.

The base unit 18 further comprises roller means for moving the vacuum cleaner 10 across a flat surface. In the embodiment illustrated in the drawings, such roller means includes a plurality of wheels 26 disposed, for example, at each of the four corners of the base unit 18.

The air blower 14 is disposed within the chassis 12. The air blower 14 is typically an electrically driven air blower having a capacity between about 50 $m^3$/hour and about 200 $m^3$/hour. A typical electrical motor 28 for driving the blower operates on ordinary house current and has a power capacity between about 800 watts and about 2000 watts. In the embodiment illustrated in the drawings, the rotating brush 24 within the base unit 18 is rotated by a drive belt 30 which is powered by the air blower motor 28.

The dust extraction and collection unit 16 is disposed within the housing unit 20. The dust extraction and collection unit 16 comprises an enclosed inlet chamber 32 and an enclosed outlet chamber 34.

The inlet chamber 32 is substantially cylindrical in shape with an internal diameter between about 130 mm and about 200 mm, preferably between about 150 mm and about 180 mm. The inlet chamber 32 comprises a bottom wall 36, generally vertical sidewalls 38 and a top wall 40. The sidewalls 38 typically have an interior height between about 200 mm and about 250 mm, most typically between about 220 mm and about 230 mm.

The inlet chamber 32 also has an upper section 42 and a lower section 44. The sidewalls in the upper section 42 of the inlet chamber 32 define an inlet opening 46 for allowing the ingress of dusty air from the base unit 18. The inlet opening 46 of the inlet chamber 32 is configured to provide the ingress of dusty air into the inlet chamber 32 in tangential fashion wherein the ingressing dusty air is caused to downwardly spiral around the internal surface 48 of the inlet chamber sidewalls 38. In this regard, the lateral edges of the inlet opening 46 are beveled, the exterior wall at the upstream lateral edge of the inlet opening 46 being beveled and the interior surface of the downstream lateral edge of the inlet opening 46 being beveled.

The inlet chamber 32 is preferably reversibly installable and deinstallable within the chassis 12. In the embodiment illustrated in the drawings, the inlet chamber 32 is reversibly installable and deinstallable within the chassis 12 via a press-fit connection between the inlet chamber walls and the walls of the chassis 12. In another embodiment (not shown), the inlet chamber 32 is reversibly installable and deinstallable within the chassis 12 using a snap-on connection.

The outlet chamber 34 is disposed concentrically within the upper section 42 of the inlet chamber 32. The outlet chamber 34 has a bottom wall 50, a top wall 52 and generally vertical sidewalls 54. The sidewalls 54 have an interior height between about 50 mm and about 100 mm, preferably between about 80 mm and about 90 mm.

The sidewalls 54 of the outlet chamber 34 are perforated with a plurality of inlet apertures 56, each defining an area between about 3 $mm^2$ and about 30 $mm^2$. In a typical embodiment, the sidewalls 54 define between about 1000 and about 1500 inlet apertures 56, preferably between about 1300 and about 1400 inlet apertures 56. Typically each of the inlet apertures 56 is separated from adjoining inlet apertures 56 by a distance of between about 1.5 mm and about 5 mm. The inlet apertures 56 are preferably disposed in a band 58 around the sidewalls 54 of the outlet chamber 34. Typically, the band 58 has a width between about 20 mm and about, 50 mm, preferably between about 30 mm and about 40 mm. The band 58 defines a median line 60 which divides the uppermost apertures 62 from a substantially equal number of lowermost apertures 64. Typically, the median line 60 is disposed between about 30 mm and about 100 mm above the bottom wall 50 of the outlet chamber 34, preferably between about 50 mm and about 60 mm above the bottom wall 50.

The outlet chamber 34 has an upper section 66 and a lower section 68. Disposed around the sidewalls 54 in the lower section 68 of the outlet chamber 34 is an exterior perimeter edge member 70. The purpose of the exterior edge member 70 is to provide a narrowing of the open annulus 72 between the interior surface 48 of the inlet chamber 32 and the exterior surface 74 of the outlet chamber 34 proximate to the bottom wall 50 of the outlet chamber 34. In a typical embodiment, the exterior edge member 70 has a diameter between about 10 mm and about 60 mm less than the internal diameter of the inlet chamber 32, preferably between about 10 mm and about 20 mm less than the internal diameter of the inlet chamber 32.

In a preferred embodiment, a cylindrical filter 76 is disposed vertically and concentrically within the outlet chamber 34. Typically, such cylindrical filter 76 is made from polypropylene, paper, ceramic or polytetrafluoroethylene having a thickness between about 1.5 mm and about 5 mm.

The top wall 52 of the outlet chamber 34 defines a top wall opening 78. Typically, the top wall opening 78 is disposed in the center of the top wall 52.

In another preferred embodiment, the outlet chamber 34 comprises a planar filter 80 disposed across the top wall 78 opening of the outlet chamber 34. In a typical embodiment, such planar filter 80 is made from sponge, fibrous polyethylene, fibrous polypropylene or paper, and typically has a thickness between about 5 mm and about 15 mm.

Figure 7:
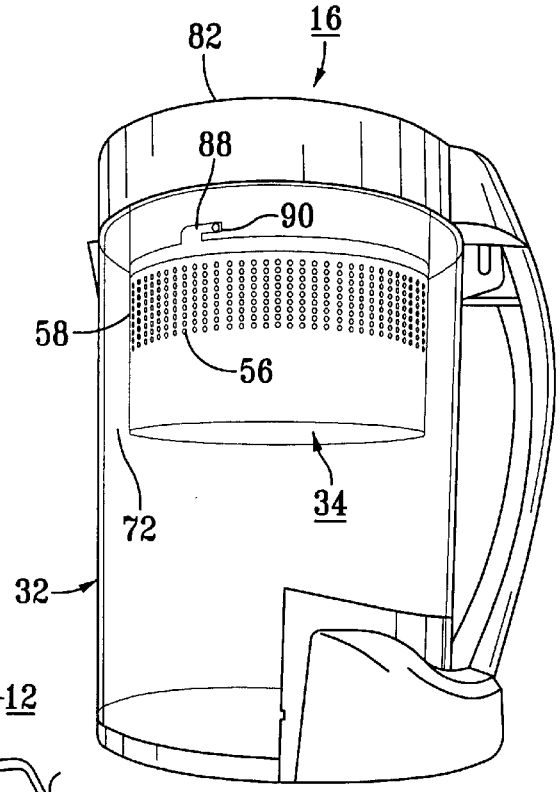
FIG. 7 is a perspective view of a dust extraction and collection unit useable in the invention.
Figure 8:
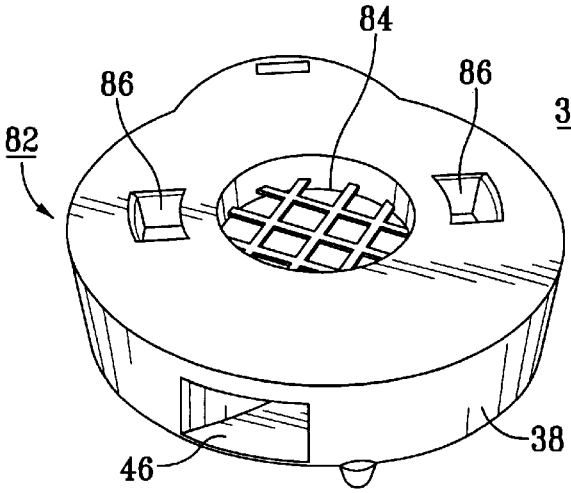
FIG. 8 is a perspective view of a cover useable to enclose the dust extraction and collection unit illustrated in FIG. 7.
Figure 9:
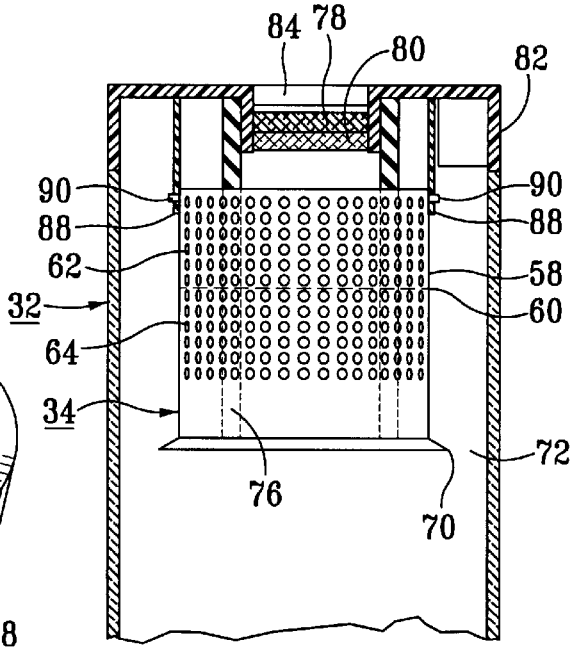
FIG. 9 is a detailed cross-sectional side view of a dust extraction and collection unit illustrated in FIG. 7.

As illustrated in FIGS. 7–9, the top wall 40 of the inlet chamber 32 can preferably be provided with a removable cover 82 having a central cover discharge opening 84. In the embodiment illustrated in FIGS. 7–9, the cover 82 further provides the uppermost portion of the sidewalls 38 of the inlet chamber 32. The air opening 46 to the inlet chamber 32 is provided by an air inlet opening 46 within the cover 82. A pair of opposed finger gripping depressions 86 can be disposed in the top surface of the cover 82 to facilitate the cover's removal and reinstallation. In the embodiment illustrated in the drawings, the outlet chamber 34 is attached to the removable cover 82 by a pair of opposed connection hooks 88 disposed over corresponding connection dogs 90.

Figure 10:
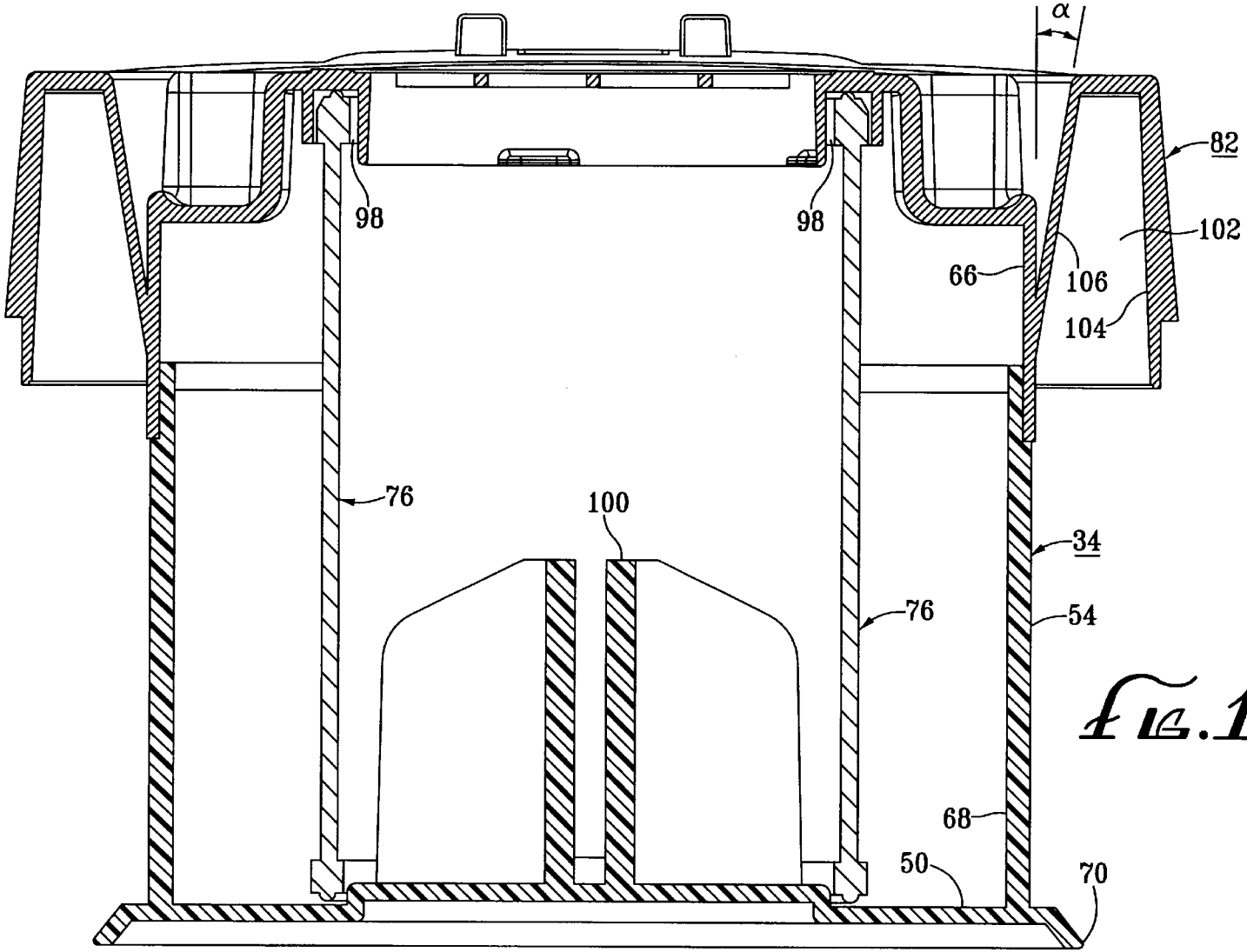
FIG. 10 is a detailed cross-sectional side view of another dust extraction and collection unit useable in the invention.

FIG. 10 illustrates another embodiment of a cover 82 and outlet chamber 34 useable in the invention. In the embodiment illustrated in FIG. 10, the cylindrical filter 76 is disposed within a circular groove 98 defined on the underside of the cover 82. The cylindrical filter 76 is laterally supported at its base by a filter support structure 100 disposed in the lower section 68 of the outlet chamber 34.

The cover defines a plenum 102 into which dusty air is initially directed into the dust extraction and collection unit 16. The plenum 102 has a generally vertical outside wall 104 and a non-vertical inside wall 106. The non-vertical inside wall 106 is slanted outwardly with respect to the vertical by an angle which is between about 0° and about 40°, preferably between about 15° and about 25°. The interior height of the plenum 102 is typically between about 20 mm and about 50 mm, preferably between about 40 mm and about 45 mm. This particular configuration has been found to be particularly advantageous in the invention.

The invention further comprises duct work 92 for serially connecting in fluid communication the air inlet 22 in the base unit 18, the inlet chamber 32, the outlet chamber 34 and the air blower 14.

It is very important that all such duct work 92 and all connection points within the duct work and between various components in the system and/or the duct work 92 be well-sealed. Even small leaks within the system can markedly decrease efficiency and increase power requirements.

In a preferred embodiment, a blower filter 94 is operatively disposed downstream of the air blower 14. Preferably, such blower filter 94 is a HEPA filter.

In operation, the blower motor 28 is first engaged so as to activate the air blower 14 and to rotate the floor brush 24 via the brush drive belt 30. The vacuum cleaner 10 is then pushed across a dusty horizontal surface, such as a floor or a rug, using the handle 96 disposed at the top of the chassis 12.

As the vacuum cleaner 10 is pushed across the dusty horizontal surface, dust from the horizontal surface is drawn upwardly within a dusty air stream and enters the vacuum cleaner 10 through the air inlet 22 in the base unit 18. The duct work 92 directs the incoming dusty air stream into the inlet chamber 32 in tangential fashion, such that the incoming air stream within the inlet chamber 32 spirals downwardly about the internal surface 48 of the sidewalls 38 of the inlet chamber 32. After the dust-laden air stream swirls into the lower section 44 of the inlet chamber 32, the air stream reverses direction, drops in velocity and proceeds upwardly towards the outlet chamber 34. As the air reverses direction and drops in velocity, most of the entrained dust and dirt within the air stream falls out of the air stream falls out of the air stream and collects at the bottom of the inlet chamber 32. The air stream then flows upwardly past the exterior perimeter edge member 70 of the outlet chamber 34 and then into the outlet chamber 34 via the plurality of inlet apertures 56. Within the outlet chamber 34, the air stream passes through the cylindrical filter 76, where additional dust within the air stream is removed. The air stream is then drawn upwardly through the top wall opening 78 of the outlet chamber 34. As the air passes through the top wall opening 78, it is filtered a second time through the planar filter 80 disposed across the top wall opening 78. The air exiting the outlet chamber 34 is then drawn into the blower 14 via the duct work 92. At the outlet of the blower 14, the air is filtered a third time through the blower filter 94. After exiting the blower filter 94, the air is exhausted to the atmosphere.

The invention has been found to provide a vacuum cleaner with all the conveniences of prior art vacuum cleaners, but with increased dust removal efficiency and without excessive mechanical complexity and resulting expense of manufacture.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A vacuum cleaner comprising:

(a) a chassis having a base unit and a housing unit, the base unit having an air inlet and roller means for moving the chassis;

(b) an air blower disposed within the housing unit;

(c) a dust extraction and collection unit disposed within the housing unit, the dust extraction and collection unit comprising:

(i) an enclosed inlet chamber, the inlet chamber being substantially cylindrical in shape with an internal diameter between about 130 mm and about 200 mm, the inlet chamber comprising a bottom wall, at least one generally vertical sidewall, an upper section, and a lower section, the sidewall having an interior height between about 200 mm and about 250 mm, the upper section of the inlet chamber having an air inlet opening through the sidewall; and (ii) an enclosed outlet chamber disposed to concentrically within the upper section of the inlet chamber, the outlet chamber having a bottom wall, a top wall and at least one generally vertical sidewall, the bottom wall of the outlet chamber being disposed spaced apart from the bottom wall of the inlet chamber, the top wall having a top wall opening, the sidewall having an interior height between about 50 mm and about 100 mm, the sidewall also having between about 1000 and about 1500 inlet apertures, each inlet aperture defining an area between about 3 $mm^2$ and about 30 $mm^2$, the inlet apertures being disposed in a band around the sidewall of the outlet chamber, the band having a width between about 20 mm and about 50 mm and a median line disposed between about 30 mm and about 100 mm above the bottom wall, the outlet chamber further having an upper section, a lower section and a circular exterior perimeter edge member disposed around the sidewall in the lower section of the outlet chamber, the exterior edge member having a diameter between about 10 mm and about 60 mm less than the internal diameter of the inlet chamber; and (d) duct work for serially connecting in fluid communication the air inlet in the base unit, the inlet chamber, the outlet chamber and the air blower.

2. The vacuum cleaner of claim 1 wherein a cylindrical filter is disposed vertically and concentrically within the outlet chamber.

3. The vacuum cleaner of claim 1 wherein a planar filter is disposed across the top wall opening of the outlet chamber.

4. The vacuum cleaner of claim 1 wherein a blower filter is operatively disposed downstream of the air blower.

5. The vacuum cleaner of claim 4 wherein the blower filter is a HEPA filter.

6. The vacuum cleaner of claim 1 wherein the inlet chamber is reversibly installable within the chassis with a press-fit connection.

7. A vacuum cleaner comprising:

(a) a chassis having a base unit and a housing unit, the base unit having an air inlet and wheels for moving the chassis;

(b) an air blower disposed within the housing unit;

(c) a dust extraction and collection unit disposed within the housing unit, the dust extraction and collection unit comprising:

(i) an enclosed inlet chamber, the inlet chamber being substantially cylindrical in shape with an internal diameter between about 130 mm and about 200 mm, the inlet chamber comprising a bottom wall, at least one generally vertical sidewall, an upper section, and a lower section, the sidewall having an interior height between about 200 mm and about 250 mm, the upper section of the inlet chamber having an air inlet opening through the sidewall; and (ii) an enclosed outlet chamber disposed concentrically within the upper section of the inlet chamber, the outlet chamber having a bottom wall, a top wall and at least one generally vertical sidewall, the bottom wall of the outlet chamber being disposed spaced apart from the bottom wall of the inlet chamber, the top wall having a top wall opening, the sidewall having an interior height between about 50 mm and about 100 mm, the sidewall also having between about 1000 and about 1500 inlet apertures, each inlet aperture defining an area between about 3 $mm^2$ and about 30 $mm^2$, the inlet apertures being disposed in a band around the sidewall of the outlet chamber, the band having a width between about 20 mm and about 50 mm and a median line disposed between about 30 mm and about 100 mm above the bottom wall, the outlet chamber further having an upper section, a lower section and a circular exterior perimeter edge member disposed around the sidewall in the lower section of the outlet chamber, the exterior edge member having a diameter between about 10 mm and about 60 mm less than the internal diameter of the inlet chamber;

(d) a cylindrical filter disposed vertically and concentrically within the outlet chamber;

(e) a planar filter disposed across the top wall opening of the outlet chamber; and (f) duct work for serially connecting in fluid communication the air inlet in the base unit, the inlet chamber, the outlet chamber and the air blower.

8. The vacuum cleaner of claim 7 wherein a blower filter is operatively disposed dowmstream of the air blower.

9. The vacuum cleaner of claim 8 wherein the blower filter is a HEPA filter.

* * * * *